US007131556B2

(12) United States Patent
Tseng

(10) Patent No.: US 7,131,556 B2
(45) Date of Patent: Nov. 7, 2006

(54) PRESSURED DRINKING WATER DISPENSER

(76) Inventor: Jui-Tsun Tseng, No. 417-100, Sec. 4, Kung Hsueh Road., Tainan (TW) 709

( * ) Notice: Subject to any disclaimer, the term of this patent is extended or adjusted under 35 U.S.C. 154(b) by 0 days.

(21) Appl. No.: 11/103,540

(22) Filed: Apr. 12, 2005

(65) Prior Publication Data

US 2006/0226176 A1 Oct. 12, 2006

(51) Int. Cl.
*B67D 5/08* (2006.01)

(52) U.S. Cl. ..... 222/64; 222/333; 222/400.8

(58) Field of Classification Search ..... 222/64, 222/333, 382, 400.8
See application file for complete search history.

(56) References Cited

U.S. PATENT DOCUMENTS 4,030,634 A * 6/1977 Osborn ..... 222/400.8
5,495,725 A * 3/1996 Middlemiss ..... 222/61
6,868,986 B1 * 3/2005 Arnold ..... 222/333

* cited by examiner

*Primary Examiner*—Philippe Derakshani
(74) *Attorney, Agent, or Firm*—Bacon & Thomas, PLLC

(57) ABSTRACT

A pressured drinking water dispenser includes a control device and an air and water connector inserted in the cap of a tank. The control device and the water connector are mutually connected with an air tube and a water tube between. The control device has a circuit board, an air pump and an electromagnetic valve. The air pump and the electromagnetic valve are mutually connected with an air joint and an air tube. The air and water connector is inserted in the cap of a tank, having an air joint and a water joint respectively connected with the air tube and the water tube. When the air pump is electrified to pump air, with the electromagnetic valve electrified to be closed, the air may flow orderly through the air route into the tank to become highly compressed air to force the drinking water therein to flow through the water route into the water container in the dispenser body.

8 Claims, 18 Drawing Sheets

PRESSURED DRINKING WATER DISPENSER

BACKGOUND OF THE INVENTION

1. Field of the Invention

This invention relates to a pressured drinking water dispenser, particularly to one provided with an air-pressuring device, for a tank unnecessary to be lifted up and then reversed to be placed on a dispenser body or lowered down in filling drinking water in a water container in the dispenser body, quite easy to handle.

2. Description of the Prior Art

Nowadays, many people use drinking water contained in a tank or a large container, pouring the water in the tank into a pot or another container for directly drink or boiled for making tea. For example, a conventional tank-type drinking water dispenser 10 shown FIG. 1 includes a recessed base 101 for receiving a tank 20 full of drinking water bought in the market. But the tank 20 has to be lifted up and reversed before placed on the base 101, and the drinking water flows out of the mouth of the tank 20 into the dispenser 10 for use. After all the drinking water in the tank 20 is used up, then the empty tank 20 is taken off the base 101, and a new tank 20 full of drinking water is to be placed reversely on the base 20 again.

However, this conventional tank-type drinking water dispenser 10 is very inconvenient to handle, with the tank heavy with drinking water needed to be lifted up and then reversed upside down to be received on the base 101 of the dispenser 10.

SUMMARY OF THE INVENTION

This invention has been devised to offer a pressured drinking water dispenser, which has a tank for drinking water is not needed to be lifted up and reversed to be placed on a dispenser body, but pumping the drinking water therein to flow into the dispenser body or a water container placed on the dispenser body for convenience of handling.

One feature of the invention is a control device consisting of a circuit board, an air pump and an electromagnetic valve. The air pump and the electromagnetic valve are connected with an air outlet joint and an air inlet joint.

Another feature of the invention is an air and water connector connected with the control device via an air tube and a water tube and inserted in the tank cap of a tank, having an air joint and a water joint to respectively connected with one end of the air tube and the water tube, which both have the other ends respectively connected with an air joint and an water joint of the control device. Further the air and water connector has a water tube connected with its own water joint and extends to the bottom of the tank.

In using, when the air pump is electrified to begin pumping air and the electromagnetic valve is electrified to close up, air will flow through the air joint of the control device, the air tube, the air joint of the air and water connector into the tank to be gradually become highly pressured air, which may push forcefully the drinking water to flow through the water tube in the tank, the water tube, into the water joint of the control device and then into a water container of the dispenser body. Thus the tank is not needed to be lifted up and reversed to be placed on the dispenser body as the conventional drinking water dispenser is.

A second embodiment of a control device has a cap, a separating plate and a funnel-shaped base. The separating plate is positioned between the cap and the funnel-shaped base, and the circuit board, the air pump and the electromagnetic valve are properly fixed on an upper surface of the separating plate, and the funnel-shaped base is directly inserted in a receptive base of the dispenser body for the drinking water flowing from the tank to fall down into a inner hollow functioning as a water container.

The second embodiment of a control device further has a shell, which has a tubular member extending down to fit around a mouth of the tank, a recess formed in an upper portion of the shell. Plural ribs are provided spaced apart and projecting on an annular wall defining the recess, with a center hole bored in the bottom of the recess and communicating with the tubular member, and with an insert base inserted in the center hole. Then the circuit board, the air pump and the electromagnetic valve are properly fixed in the hollow interior of the shell. Further a water container is provided, having its lower portion fitted in the recess of the shell and supported on ribs formed on an inner wall defining the recess. The water container has a water tube extending vertically in its center portion, a faucet attached at an outer lower surface, so the drinking water in the tank flows through the water tube in the tank, a water joint and into the water container for dispensed out of the faucet for use.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
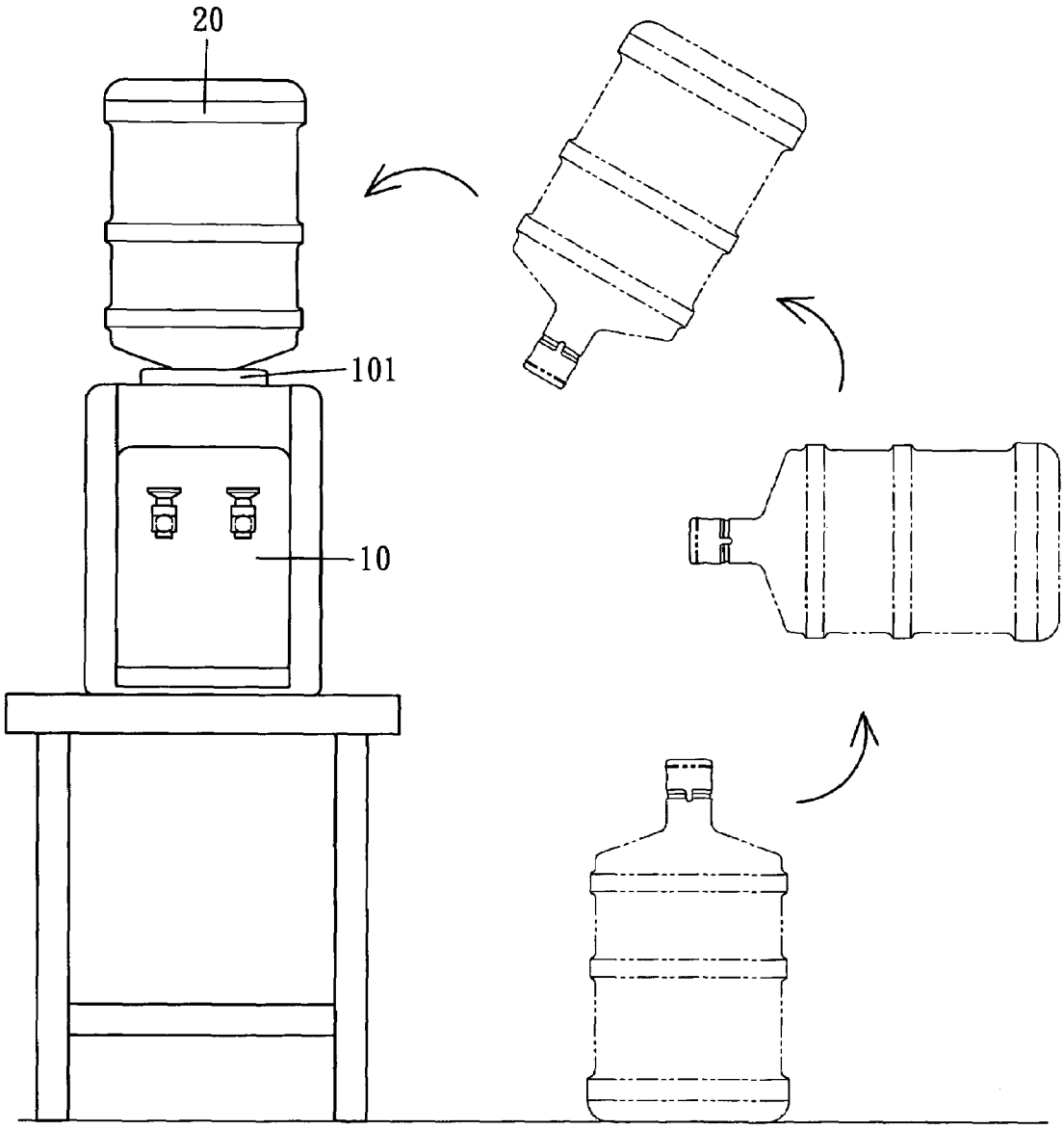
FIG. 1 (PRIOR ART)
FIG. 1 is a perspective view of a conventional tank-type drinking water disperser, showing a tank lifted and reversed to be placed on a receptive base of the dispenser.
Figure 2:
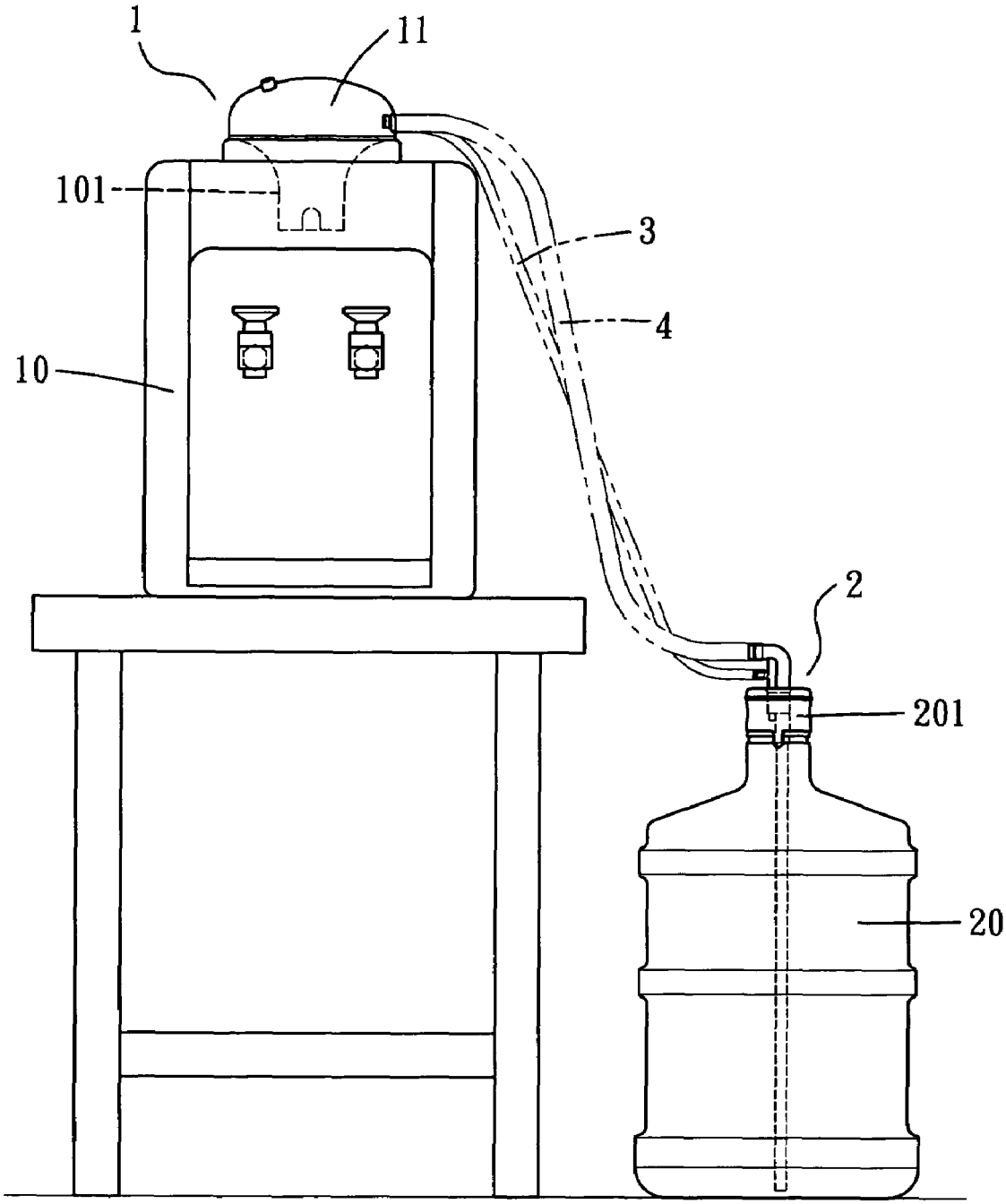
FIG. 2 is a side view of a first embodiment of a tank-type drinking water dispenser in the present invention.

A first embodiment of a tank-type drinking water dispenser 10 in the present invention, as shown in FIG. 2, includes a dispenser body 10, a receptive base 101 on an upper surface of the dispenser body 10, a control device 1 an air and water connector 2 inserted in a tank cap 201 of a tank 20, an air tube 3 and a water tube 4 provided between the control device 1 and the air and water connector 2, as main components.

The control device 1, as shown in FIGS. 2, 3, 4 and 5, consists of a cap 11 of a curved-up round shape, a separating plate 12, and a funnel-shaped base 13.

Figure 4:
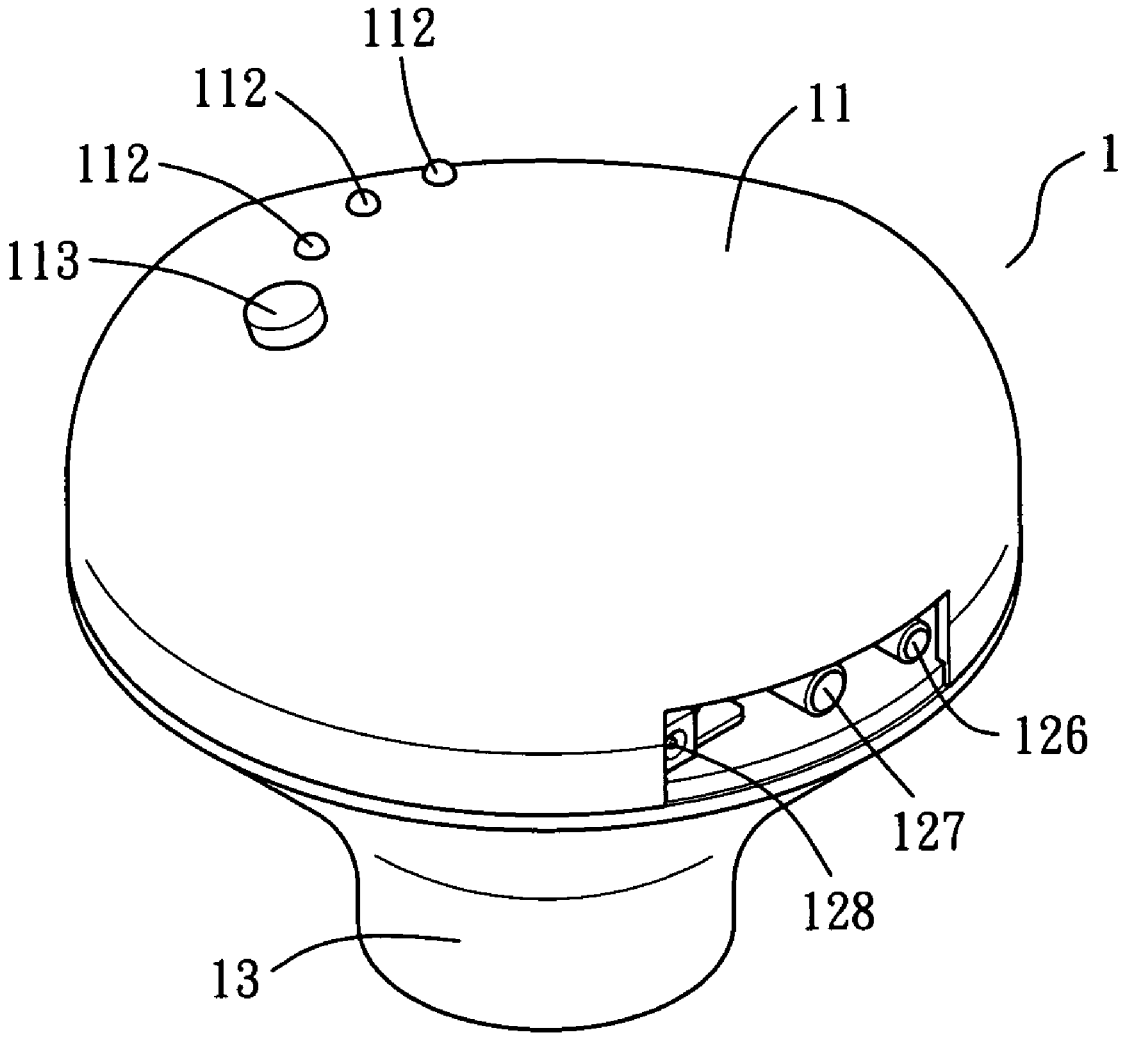
FIG. 4 is a perspective view of the control device in the first embodiment of a tank-type drinking water dispenser in the present invention.

The control device 1 further has a circuit board 111, an air pump 122 and an electromagnetic valve 123, and the circuit board 11 is fixed in an interior of the cap 11, and plural indicating lamps 112 respectively indicating the power, a high water level and a low water level, and a switch 113 are fixed on the circuit board 112, as shown in FIG. 4.

Figure 3:
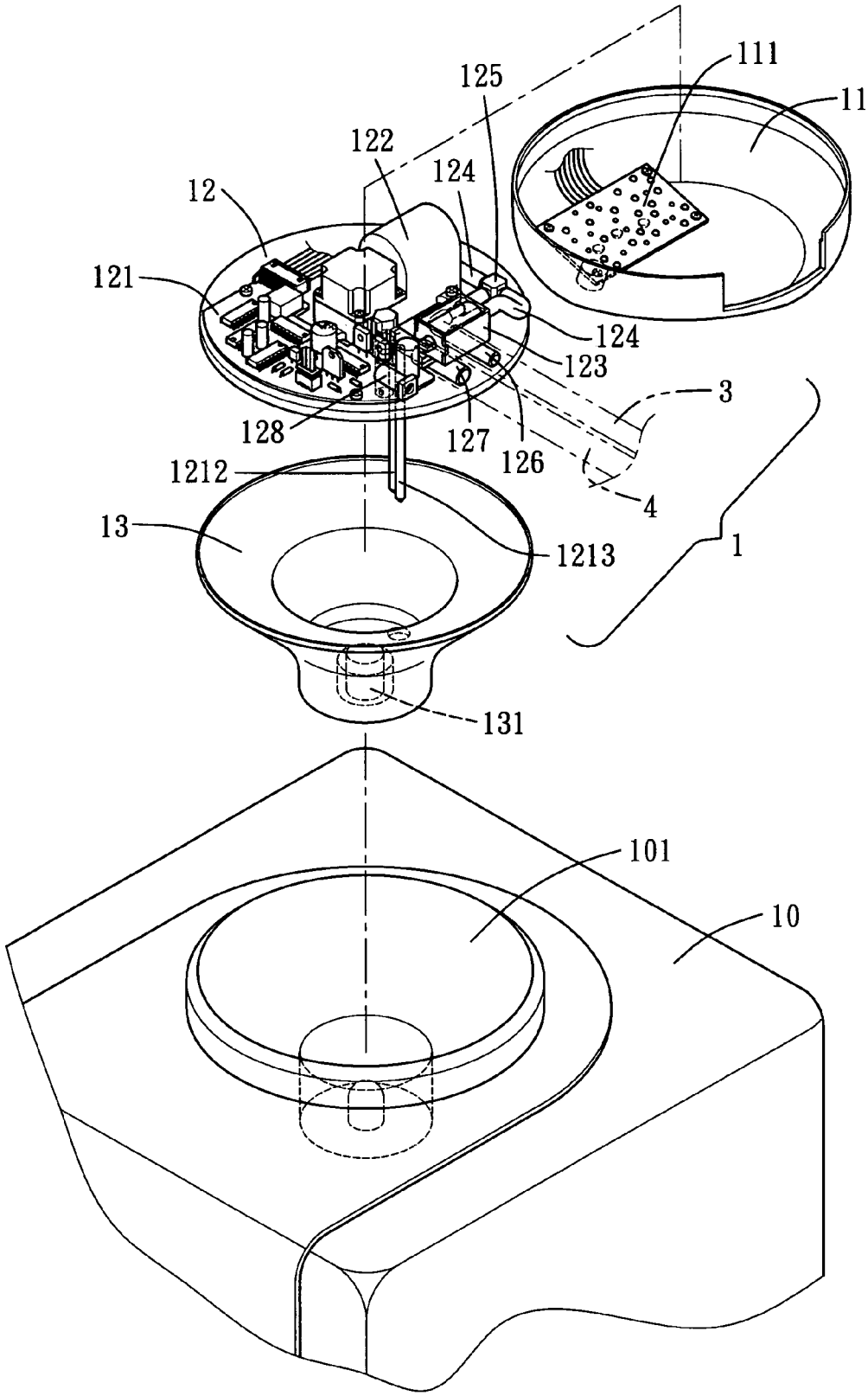
FIG. 3 is an exploded perspective view of a control device in the first embodiment of a tank-type drinking water dispenser in the present invention.
Figure 5:
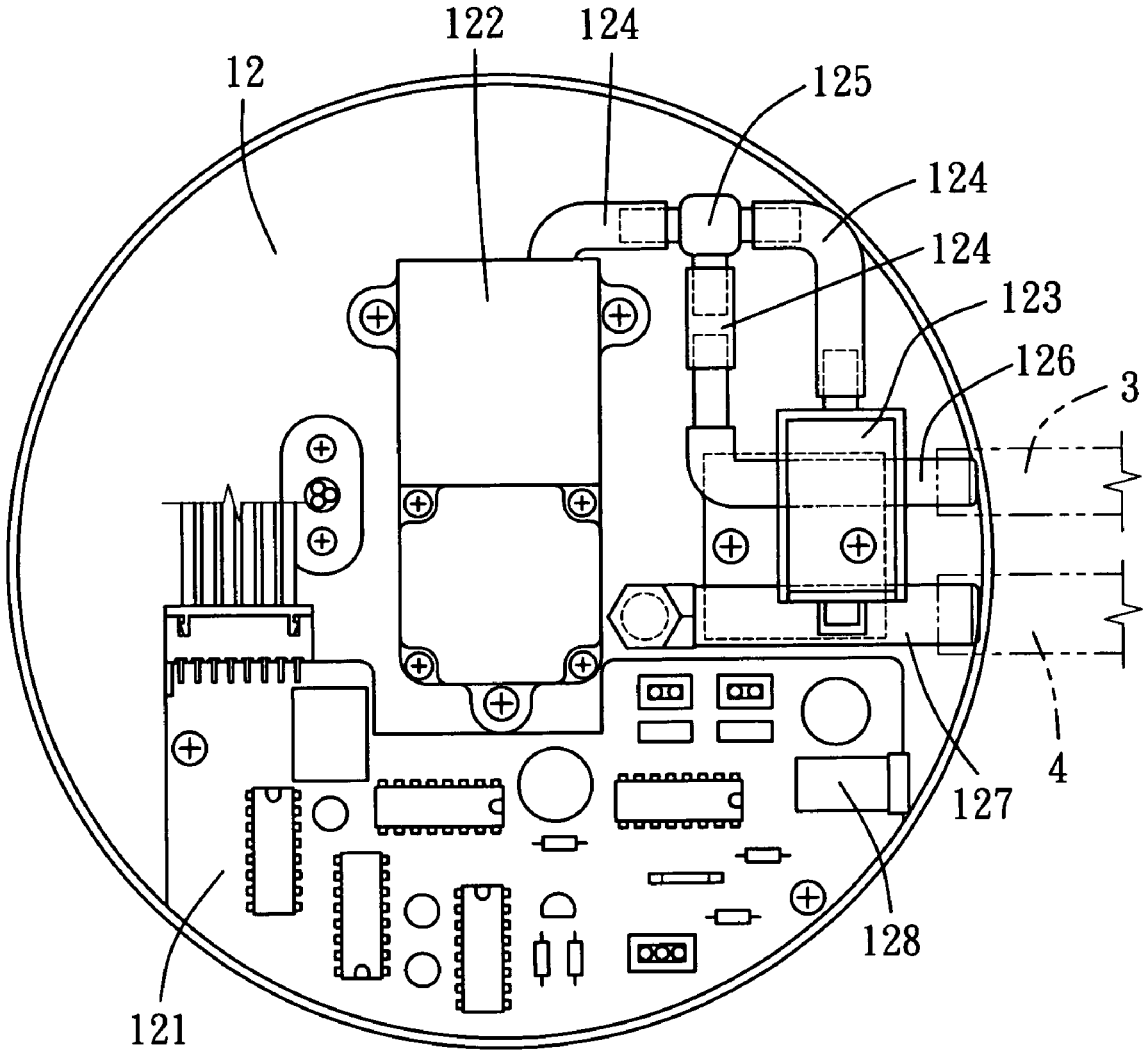
FIG. 5 is an upper view of the interior of the control device in the first embodiment of a tank-type drinking water dispenser in the present invention.
Figure 8:
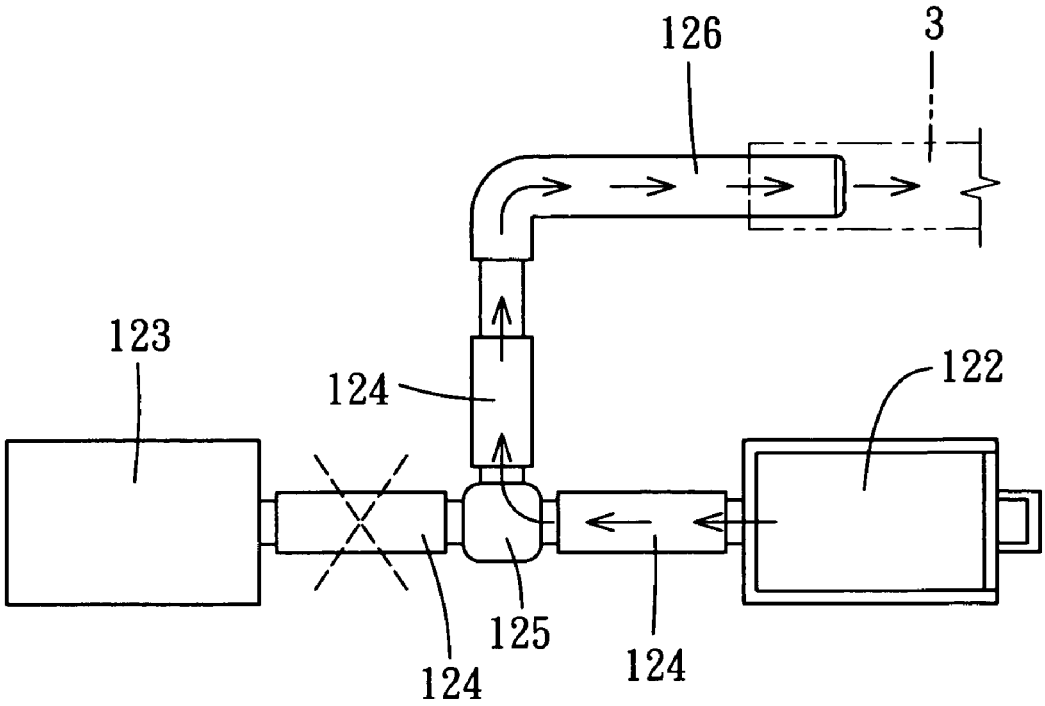
FIG. 8 is a side view of an electromagnetic valve in the first embodiment of a tank-type drinking water dispenser in the present invention, showing air flowing toward a tank in case of the electromagnetic valve electrified.
Figure 11:
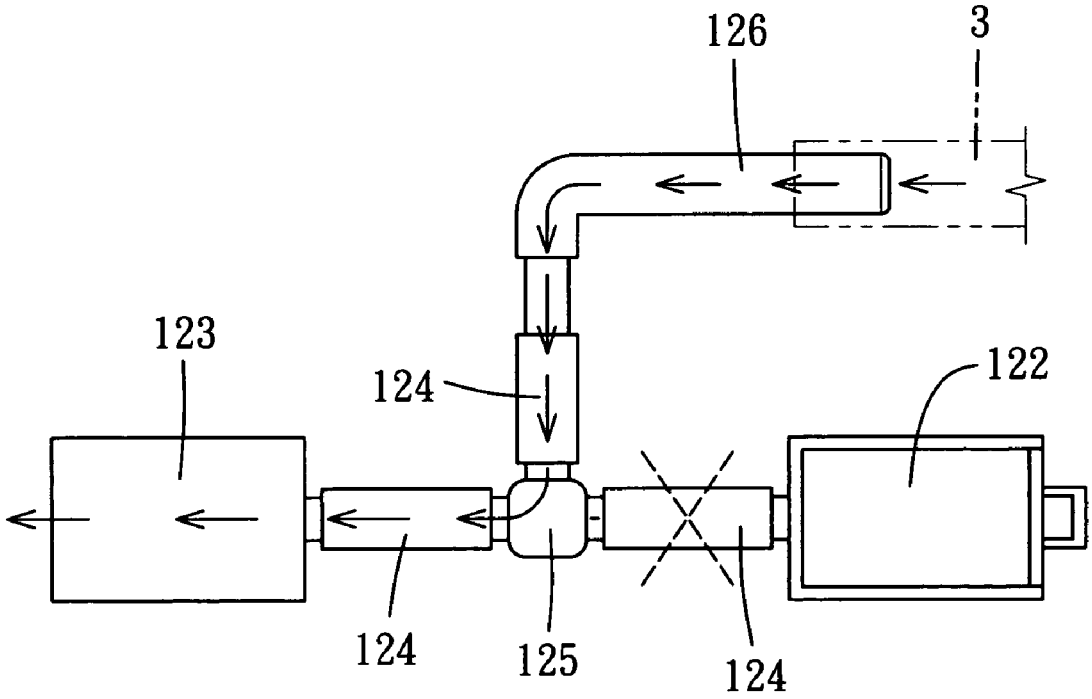
FIG. 11 is a side view of the electromagnetic valve of the first embodiment of a tank-type drinking water dispenser in the present invention, showing air exhausted out in case of the electromagnetic valve electrically cut off.

The separating plate 12 is positioned between the cap 11 and the funnel-shaped base 13, having the circuit board 121, the air pump 122 and the electromagnetic valve 123 fixed thereon, as shown in FIGS. 3 and 5. When the electromagnetic valve 123 is electrified, it is closed up for air impossible to pass through as shown in FIG. 8, and it is opened for air to flow through in case of the electromagnetic valve cut off power, as shown in FIG. 11.

Figure 7:
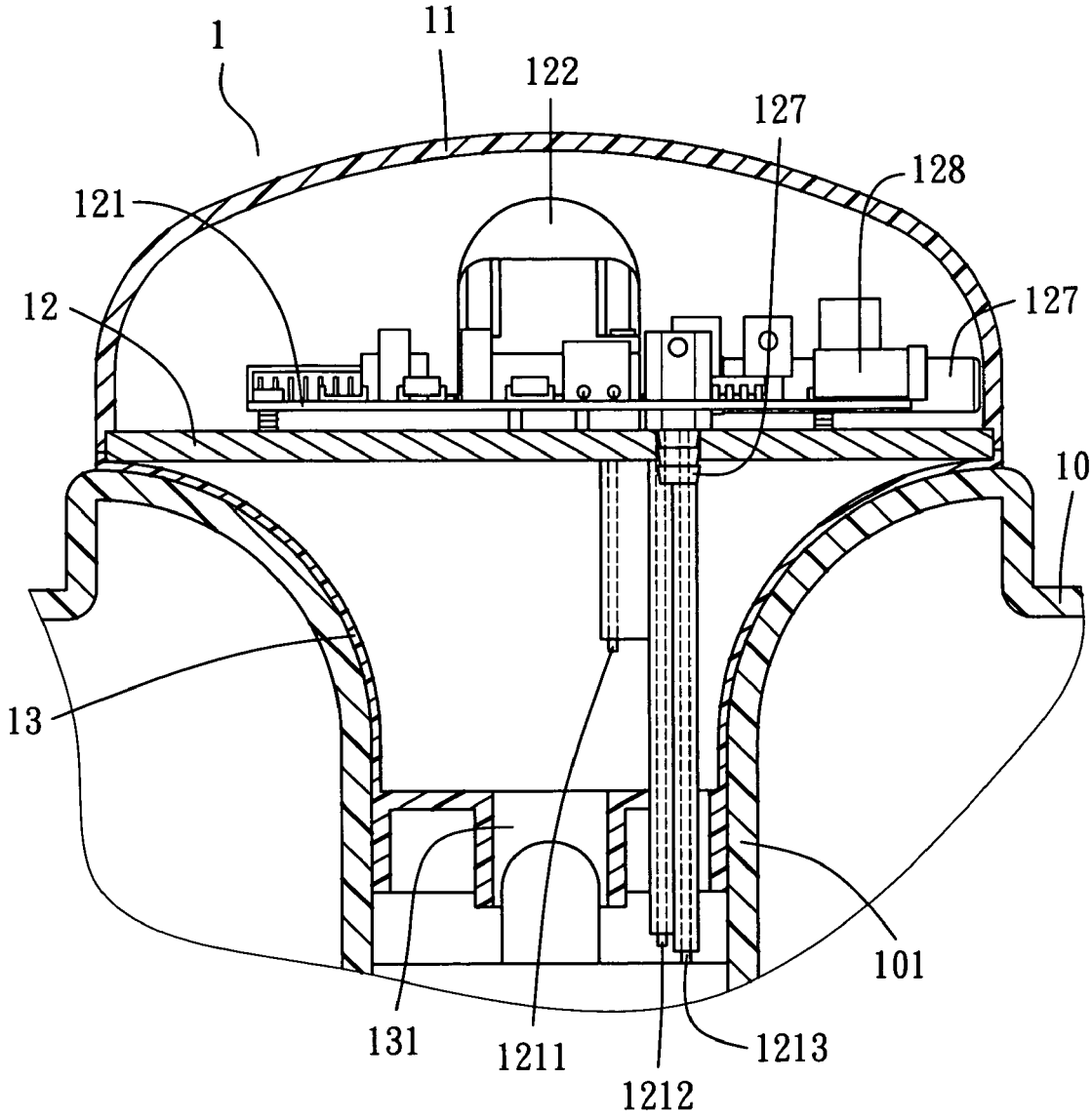
FIG. 7 is a side cross-sectional view of the control device in the first embodiment of a tank-type drinking water dispenser in the present invention.

Further, three sensing bars, a short one 1211, a medium one 1212 and a long one 1213 are provided to extend down from the circuit board 121 into the inner hollow of the funnel-shaped base 13, and the medium and the long sensing bars 1212 and 1213 further pass through the bottom of the base 13 and into the receptive base 101 of the dispenser body 10, as shown in FIG. 7.

The air pump 122 and the electromagnetic valve 123 on the separating plate 12 are mutually connected with an air tube 124 and a T-shaped joint 125, and the other end of the T-shaped joint 125 is connected with an air outlet joint 126 via the air tube 124. Then the air outlet joint 126 has its other end connected with an air tube 3 as show in FIGS. 2 and 5. Further, the air outlet joint 126 has its other end connected with a water joint 127 of an L-shape, which has one end extending down though the inner hollow of the funnel-shaped base 13, and the other (outer) end connected with a water tube 4 as shown in FIGS. 2 and 5. Further, a power socket 128 is provided at one side of the water joint 127. The funnel-shaped base 13 has a water hole 131 formed in a lower end to communicate with the interior of the dispenser body 10.

Figure 6:
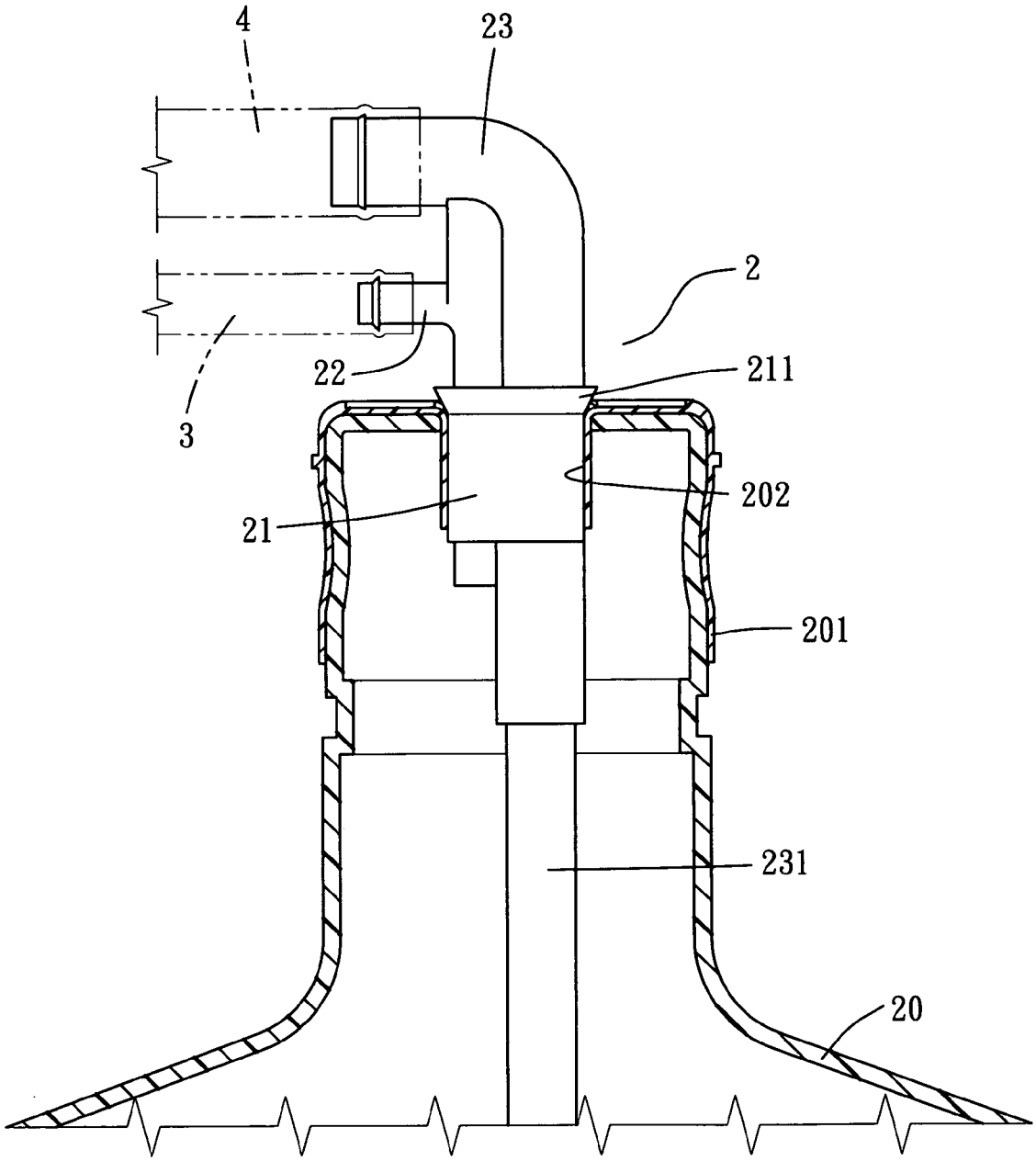
FIG. 6 is a side cross-sectional view of an air and water connector in the first embodiment of a tank-type drinking water dispenser in the present invention.

The air and water connector 2, as shown in FIGS. 2 and 6, has a body 21 inserted in a center hole 202 of the tank cap 201 of the tank 20, and a tapered section 211 formed in an upper portion of the body 21 to tightly fit with the water hole 202, an air joint 22 and a water joint 23 extending up from the body 21 for respectively connected with the air tube 3 and the water tube 4, and the air joint 22 communicate with the tank 20 for air to flow in the tank 20, and with the water joint 23 having its lower end connected with a water outlet tube 231 in the tank 20.

Figure 9:
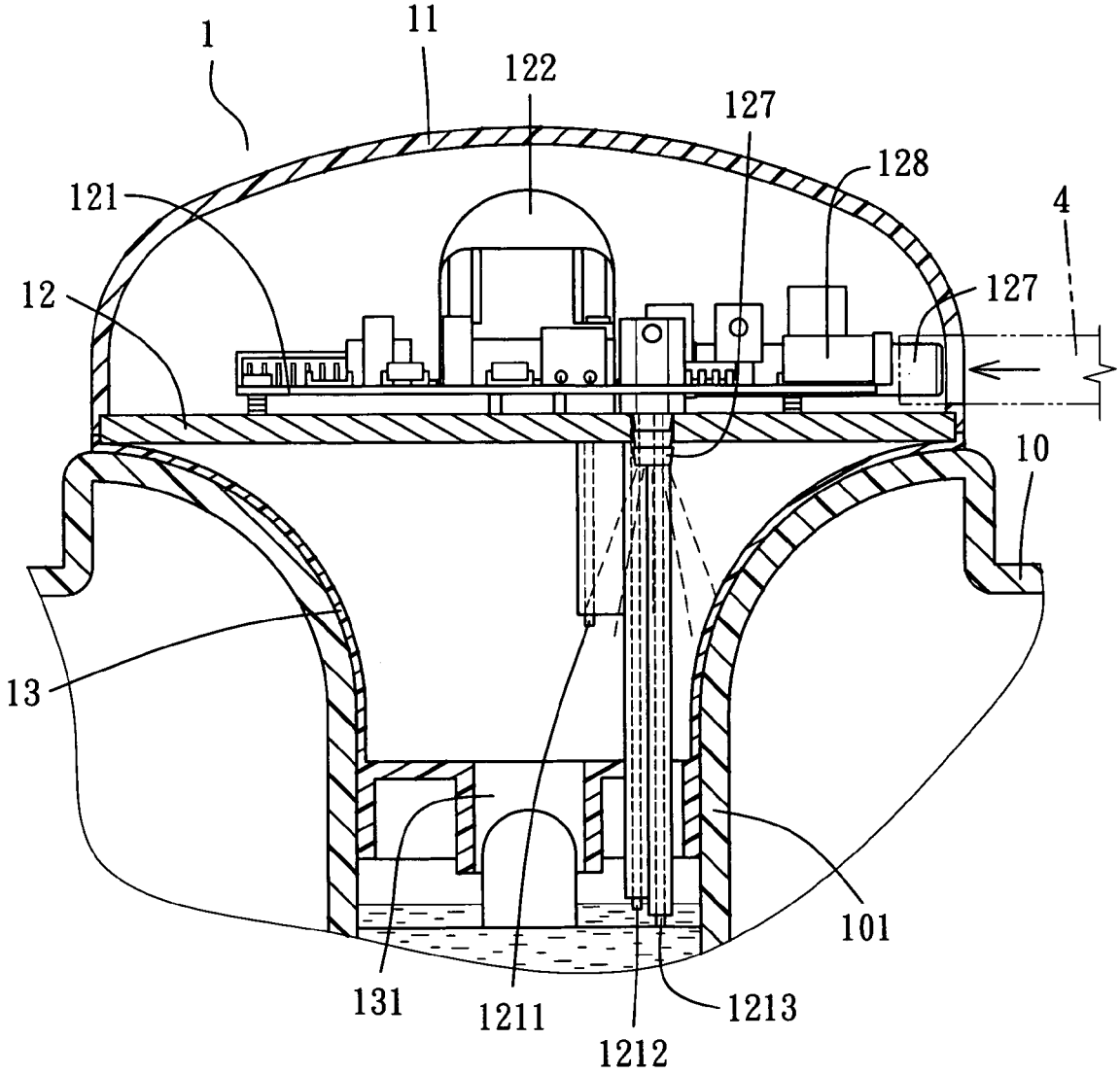
FIG. 9 is a side cross-sectional view of the control device in a condition of a low water level in the first embodiment of a tank-type drinking water dispenser in the present invention.
Figure 10:
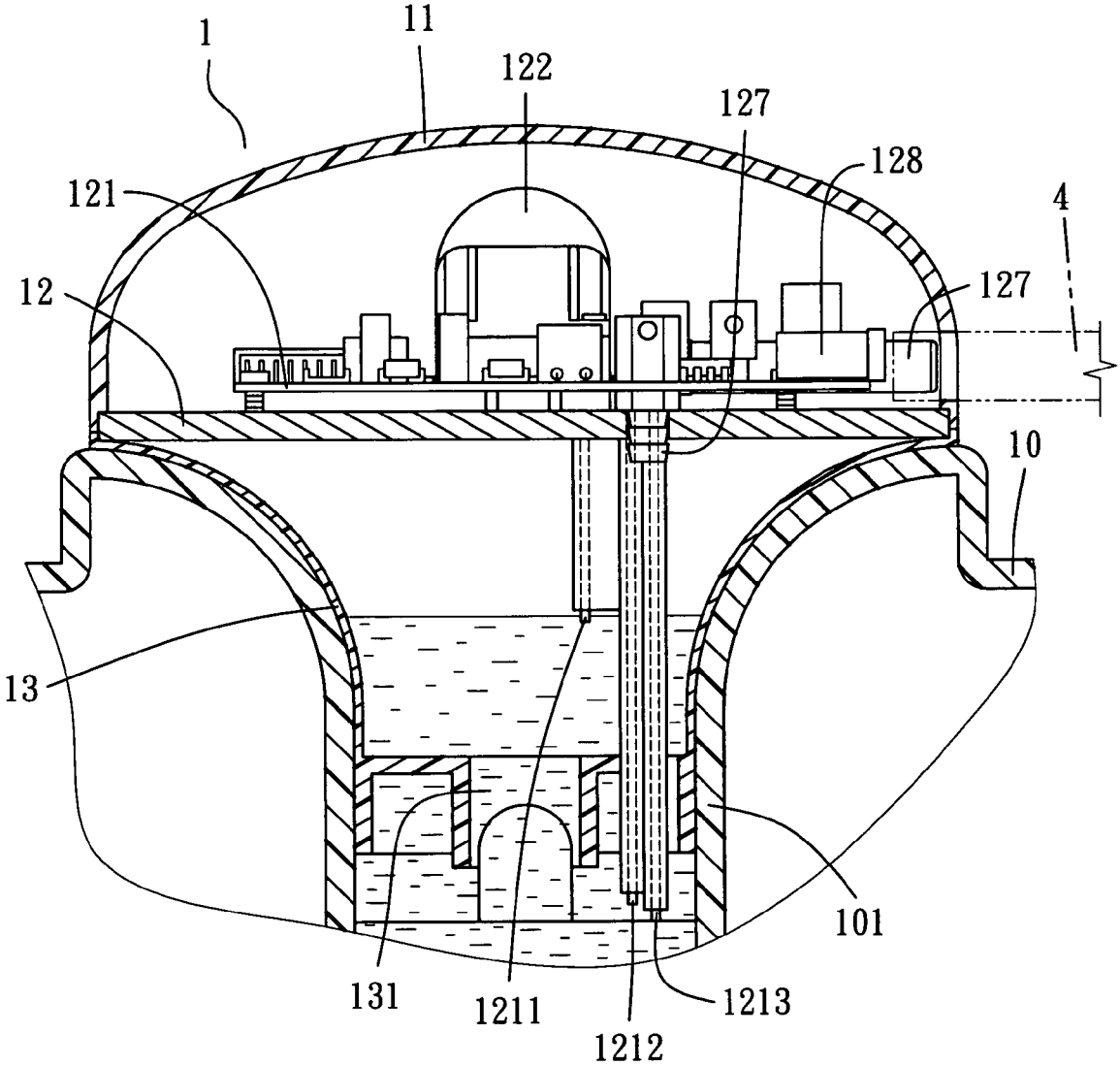
FIG. 10 is a side cross-sectional view of the control device in a condition of a high water level in the first embodiment of a tank-type drinking water dispenser in the present invention.

Next, FIGS. 2, 7–11 show how the first embodiment is used. Firstly, the control device 1 and the air and water connector 2 are respectively placed in the receptive base 101 and the water hole 202 of the tank cap of the tank 20. Then the control device 1 is connected with the power, and the power switch 113 is pressed. At this time, if the water level in the dispenser body 10 is too low, as shown in FIG. 7, with the long sensing bar 1213 still not immersed in the water, the control circuit in the control device 1 is turned on, electrifying the air pump 122 and the electromagnetic valve 123 for pumping air and closing up the valve 123 as shown in FIG. 8. Then the air pumped by the air pump 122 may flow through the air tube 124, the air outlet joint 126, the air tube 3, the air joint 22 and finally into the tank 20. Thus, highly compressed air is gradually formed in the tank 20, and if reaching a certain pressure value, it will begin to push forcefully the drinking water in the tank 20 to flow through the water outlet tube 231 of the air and water connector 2, the water tube 4, the water joint 127 of the control device 2 and then automatically pouring in the funnel-shaped base 13 and finally through the water hole 131 into the interior of the dispenser body 10. When the water level in the dispenser 10 rises gradually to immerse the medium and the long sensing bar 1212 and 1213, as shown in FIG. 9, the indicating lamps 112 may be lit up to show the water level in the dispenser body 10 already reaching a certain height. In the meantime, the air pump 122 still continues to pump air until the water level reaches the lower end of the short sensing bar 1211 as shown in FIG. 10. Then the low level-indicating lamp 112 may be cut off, and the high level-indicating lamp 112 may be lit up instead, and the air pump 122 and the electromagnetic valve 123 may be cut off the power. Then the electromagnetic valve 123 becomes opened as shown in FIG. 11 for the pressured air to flow through air joint 22, the air tube 3, the air outlet joint 126, the air tube 124, and into the electromagnetic valve 123 to be exhausted out. Thus compressed air may be avoided from continually flowing into the tank 20 to let the drinking water overfill the dispenser body 10.

When the drinking water in the dispenser body 10 is gradually used to fall down until it reaches the lower level shown in FIG. 9, the air pump 122 and the electromagnetic valve 123 are to be powered again for letting the drinking water in the tank 20 flow into the dispenser body 10 again.

Figure 12:
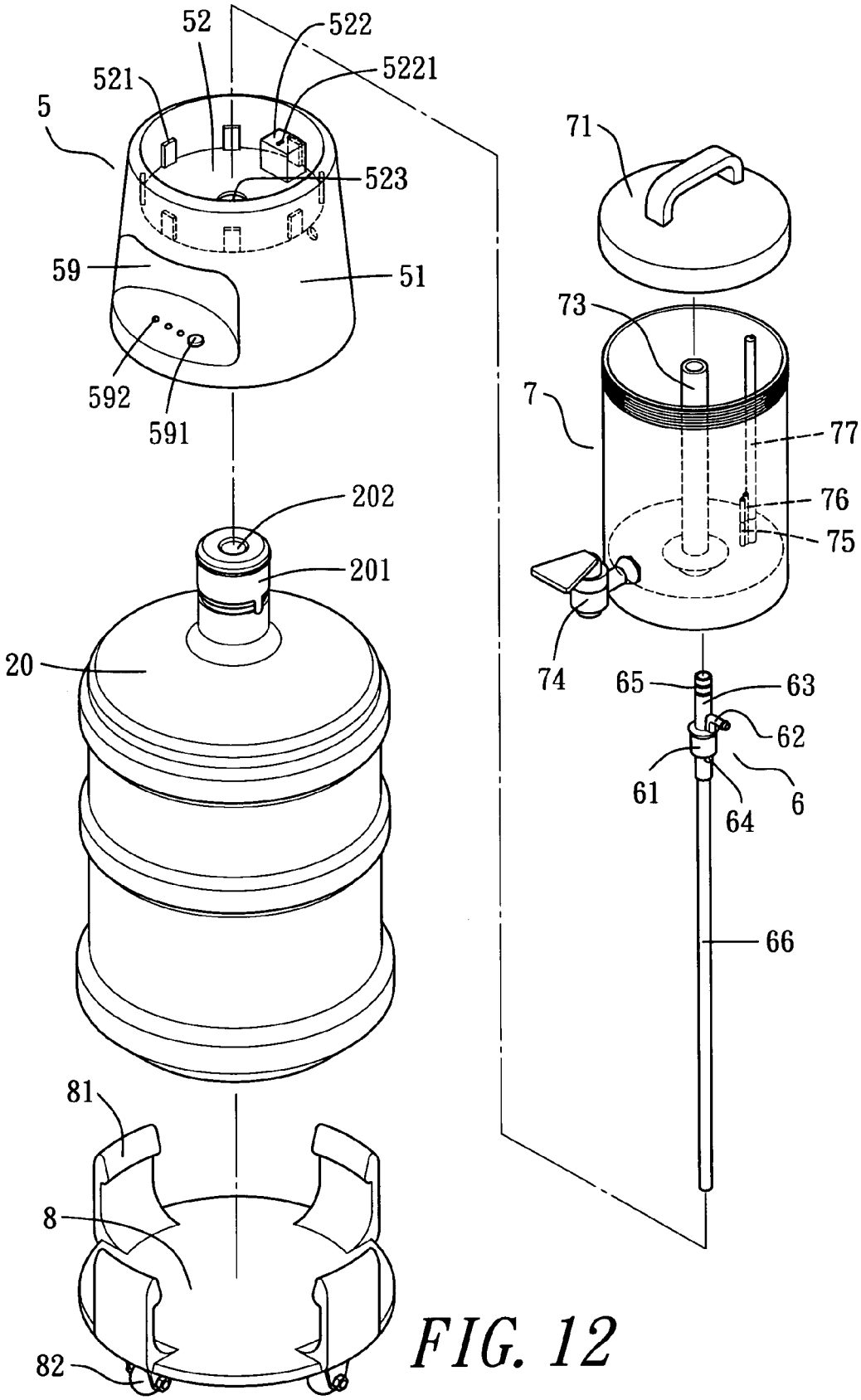
FIG. 12 is an exploded perspective view of a second embodiment of a tank-type drinking water dispenser in the present invention.
Figure 13:
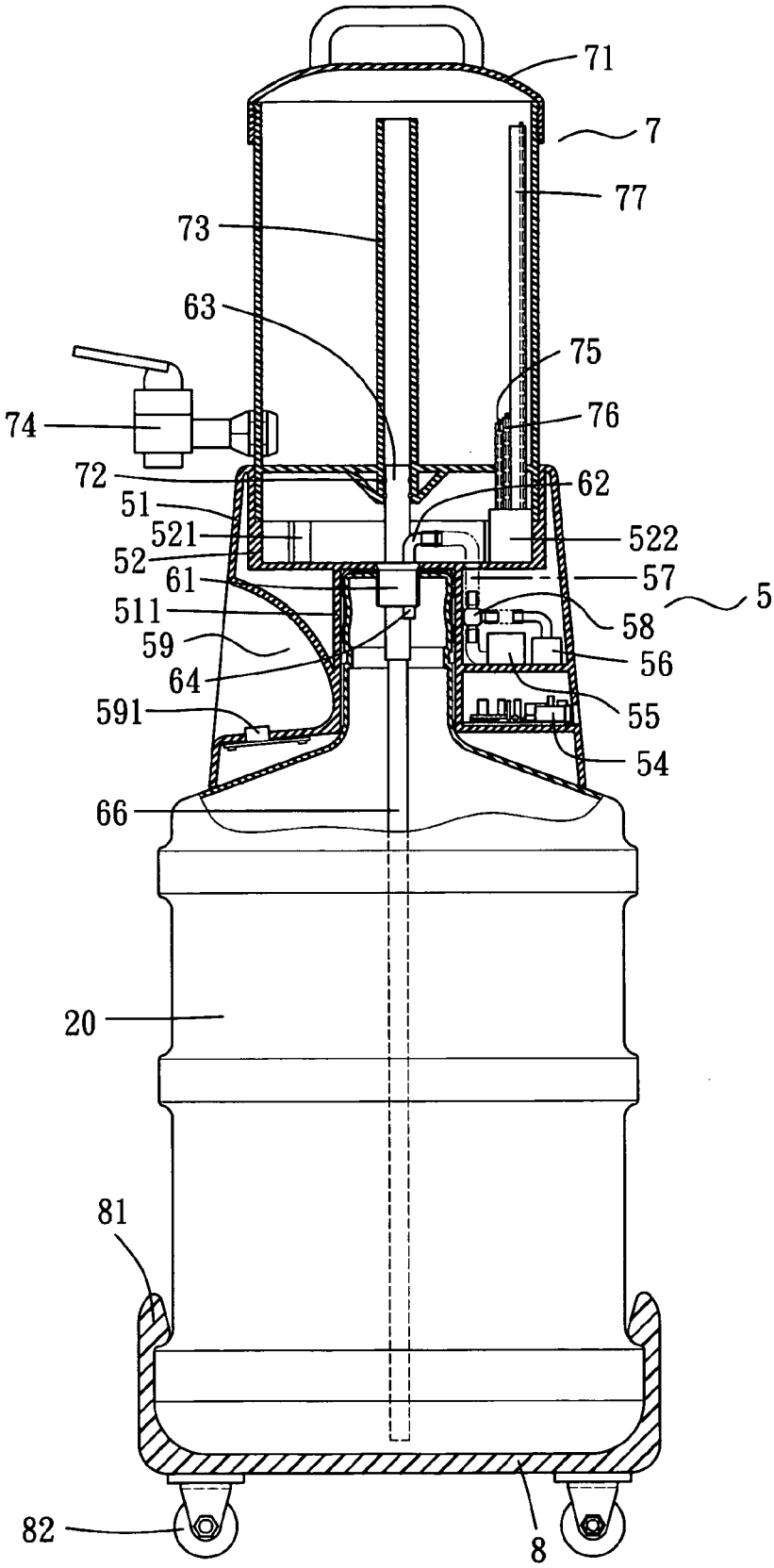
FIG. 13 is a cross-sectional view of the second embodiment of a tank-type drinking water dispenser in the present invention.
Figure 14:
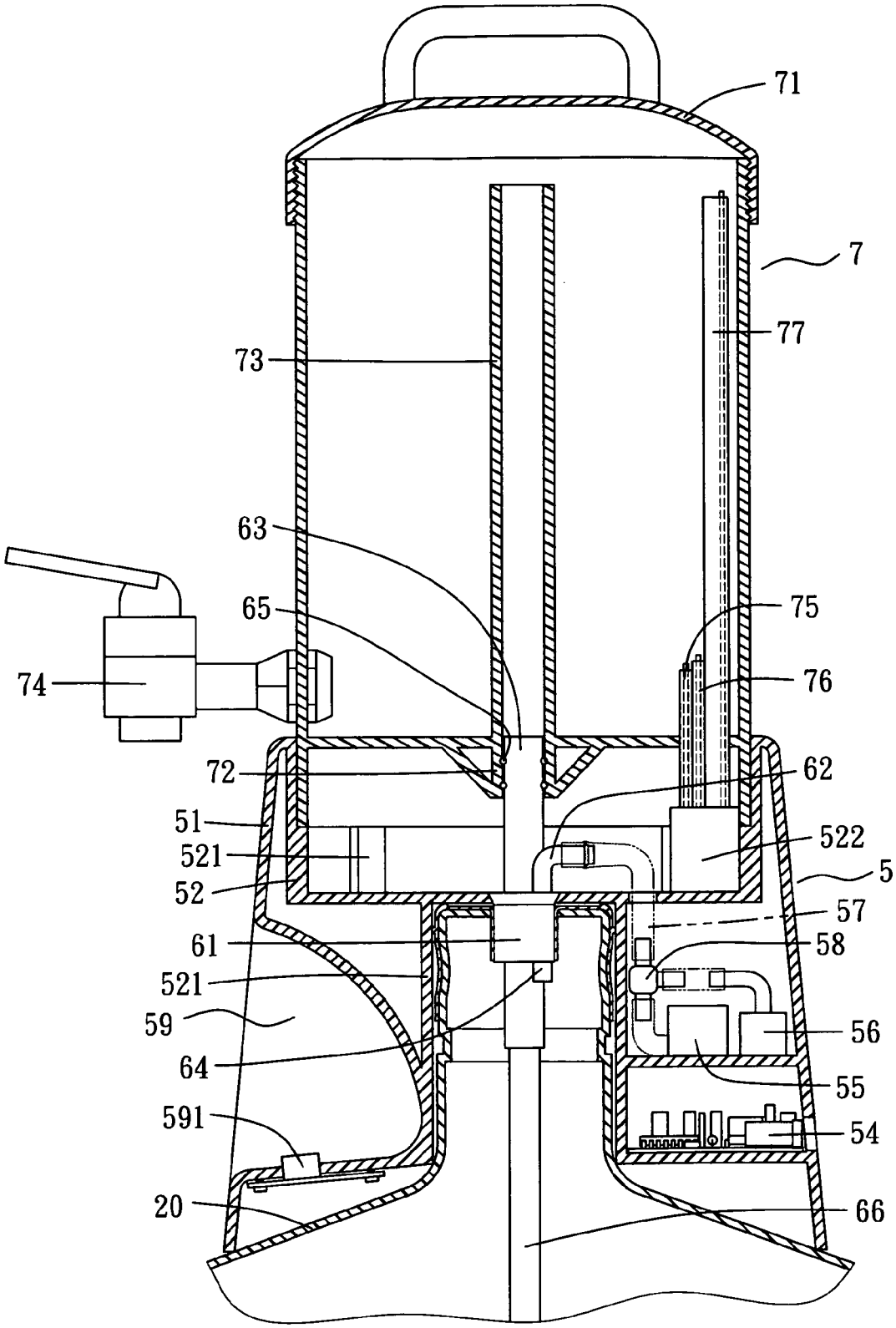
FIG. 14 is a partial magnified cross-sectional view of the second embodiment of a tank-type drinking water dispenser in the present invention.

Next, a second embodiment of a tank-type drinking water dispenser in the invention is shown in FIGS. 12, 13 and 14, including a control device 5 to be positioned on a tank 20, a water connector 6 inserted in a tank cap 201 of the tank 20, a water container 7 positioned on the control device 5, and a tank base 8 as main components.

Figure 15:
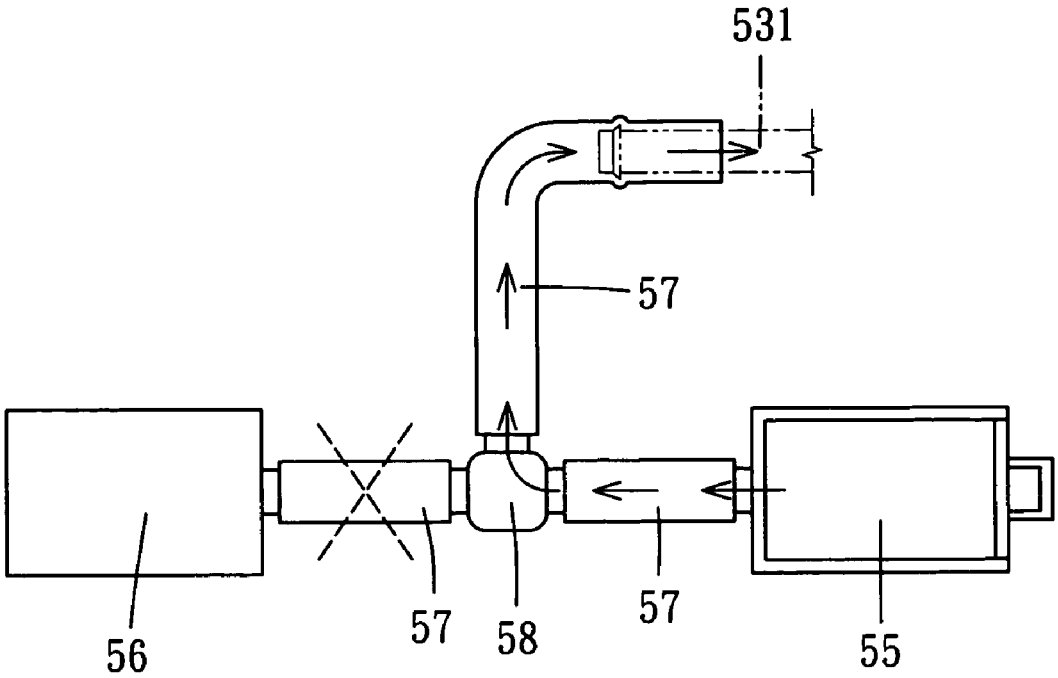
FIG. 15 is a side view of an electromagnetic valve of the second embodiment of a tank-type drinking water dispenser in the present invention, showing air flowing in a water container in case of the electromagnetic valve electrified.
Figure 19:
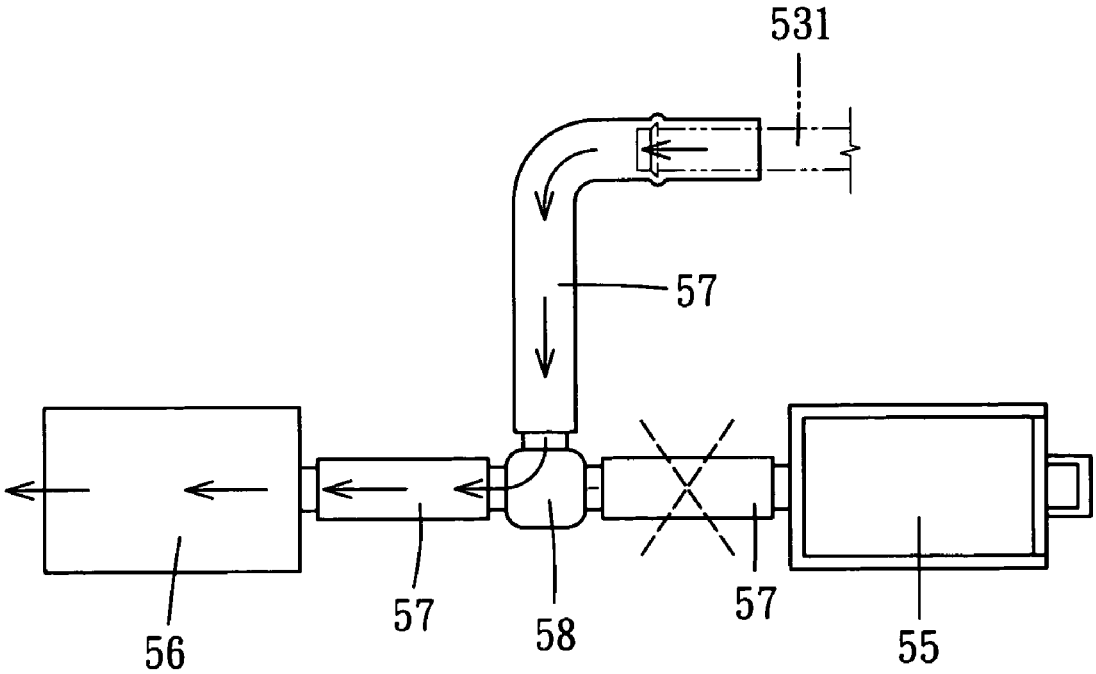
FIG. 19 is a side view of the electromagnetic valve of the second embodiment of a tank-type drinking water dispenser in the present invention, showing air being exhausted out in case of the electromagnetic valve electrically cut off; and, FIG. 20 is a cross-sectional view of the second embodiment with the water container in a using condition separated from the control device in the present invention.

The control device 5 consists of a tapered cylindrical shell 51, a tubular member 511 formed in the shell 51 and extending down to fit around the mouth of the tank 20, a recess 52 formed in an upper portion of the shell 51, a plurality of ribs 521 spaced apart equidistantly and projecting on a annular lower inner wall defining the recess 52, a micro switch 522 fixed on the bottom of the recess 52 and having three micro points 5221 on an upper surface, a center hole 523 bored in the center of the bottom of the recess 52 and communicating with the tubular member 511, a circuit board 54 fixed in an interior of the shell 51, an air pump 55 and an electromagnetic valve 56 fixed in the interior of the shell 11 above the circuit board 54. In case the electromagnetic valve 56 is electrified, it is closed up not to let air pass through, as shown in FIG. 15; in case the electromagnetic valve is cut off the power, it is opened to let air pass through, as shown in FIG. 19. The air pump 55 and the electromagnetic valve 56 are mutually connected with an air tube 57 and a T-shaped joint 62. The shell 51 is further provided with a recess 59 formed in a vertical outer surface for fixing a power switch 591 and plural indicating lamps 592 on the bottom surface of the recess 59. The plural indicating lamps 592 are respectively for indicating a power, a full water level and a low water level.

The water connector 6 has a tubular body 61 inserted in the center hole 523 of the recess 52 and in the mouth 202 of the tank 20, an air joint 62 and a water joint 63 formed in an upper end. The air joint 62 has an air mouth 64 extending down, and the water joint 63 has a waterproof gasket 65 fitted around, and a water outlet tube 66 extending down to the bottom of the tank 20, as shown in FIGS. 12 and 13.

The water container 7 has cap 71 engaging with an upper end of a container body of a cylindrical shape, its bottom inserted in the recess 52 of the shell 51 and supported by the ribs 521 in the recess 52, an insert tube 72 extending down to the bottom for the water joint 63 to insert in, a water tube 73 extending from the insert tube 72 upward in the container body. Further, a faucet 74 is fixed on an outer surface of the container 7 near the bottom, and a short sensing bar 75, a medium sensing bar 76 and a long sensing bar 77 are fixed in the shell 7 vertically. The three sensing bars 75, 75 and 77 have their lower ends contacting the three micro points 5221 of he micro switch 522 in a conductive condition. Besides, the lower ends of the short and the medium sensing bar 75 and 76 are located the same as the water faucet 74, and the upper end of the long sensing bar 77 is a little lower than that of the water tube 73, as shown in FIG. 14.

The bottom base 8 has a flat plate for the tank 20 to rest thereon, having plural securing walls 81 spaced apart equidistantly to stand on an outer circumference of the flat plate for elastically embracing the outer surface of the tank 20 tightly and plural casters 82 fixed under the flat plate to move around.

Figure 16:
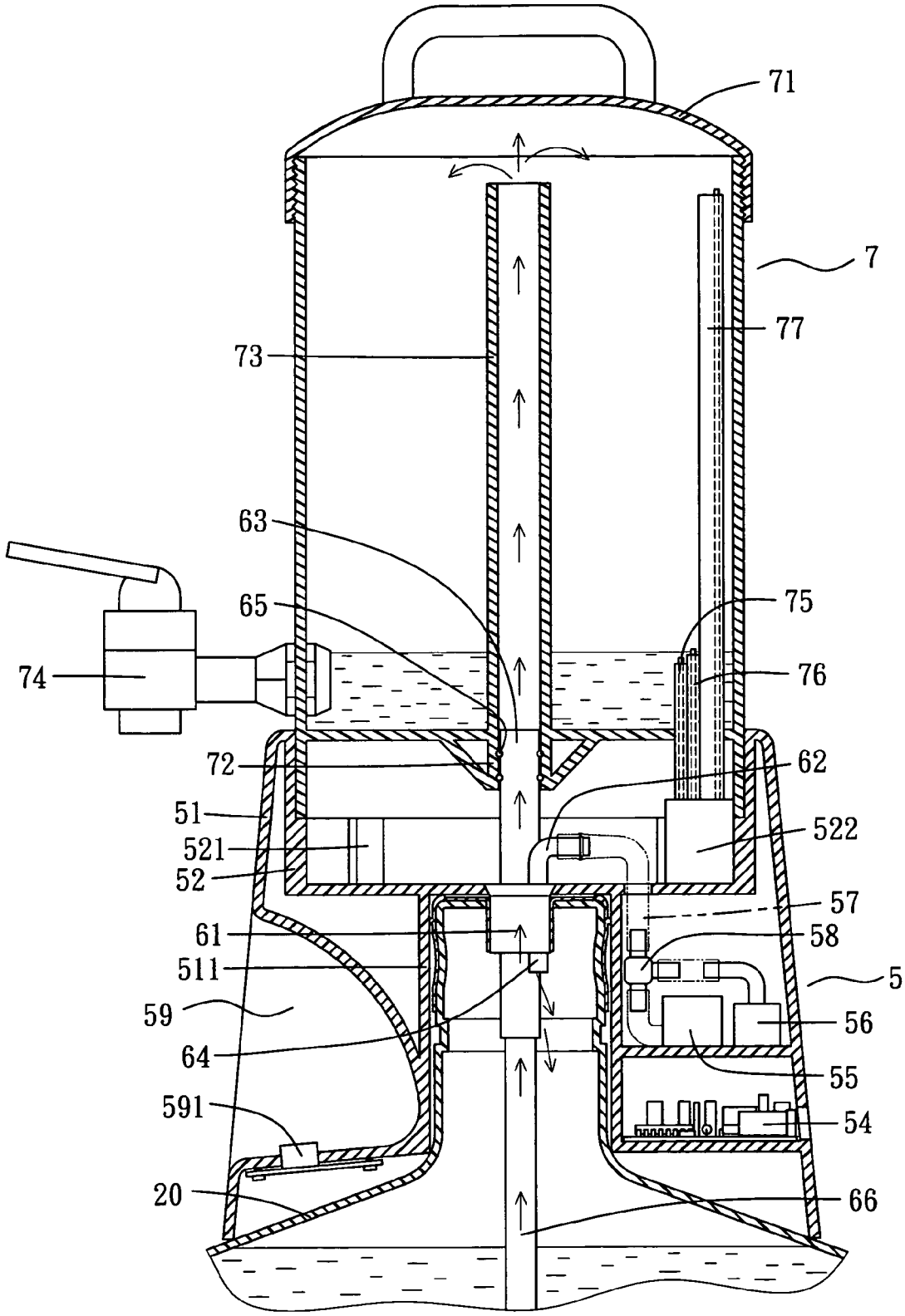
FIG. 16 is a side cross-sectional view of the second embodiment of a tank-type drinking water dispenser in the present invention, showing it in a lower water level.
Figure 17:
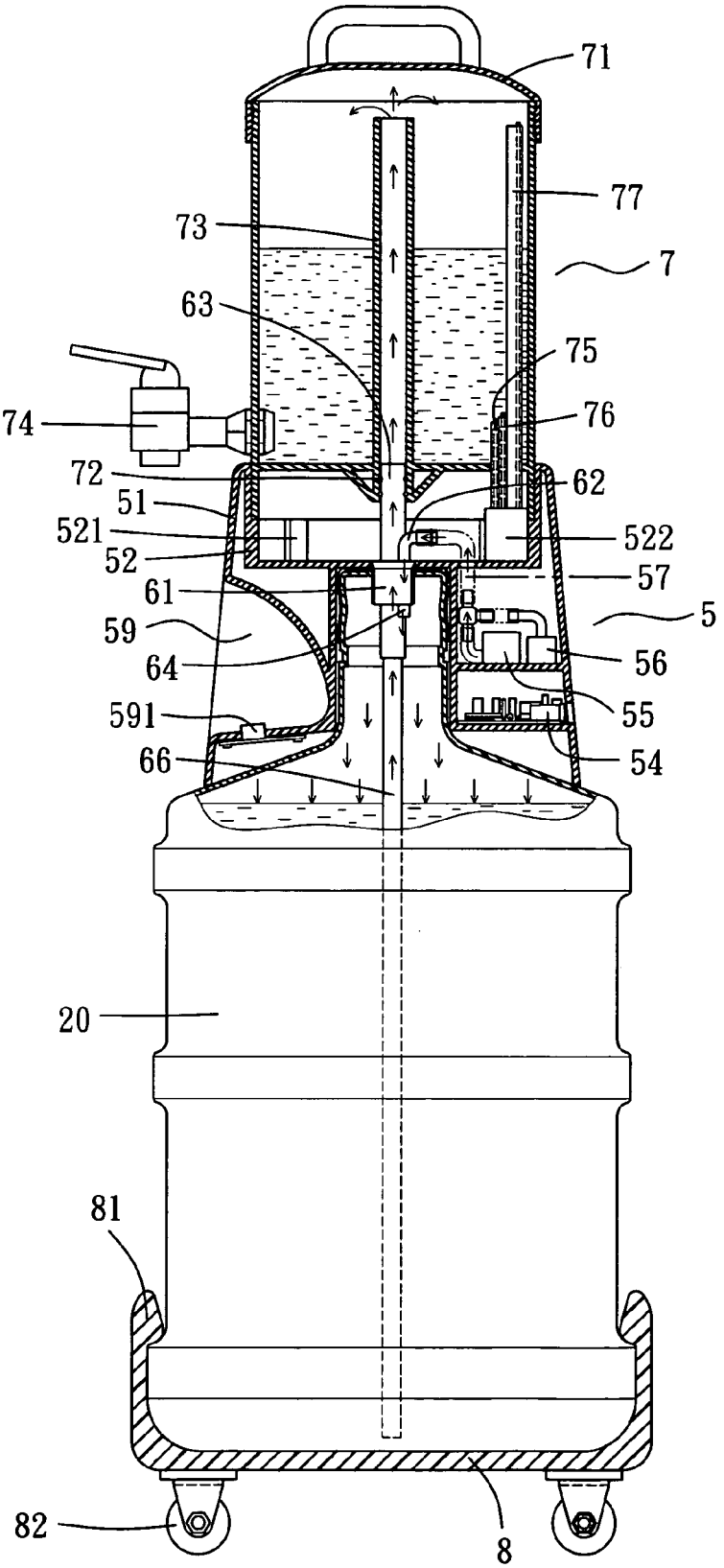
FIG. 17 is a side cross-sectional view of the second embodiment of a tank-type drinking water dispenser in the present invention, showing its water level continuing to rise up.
Figure 18:
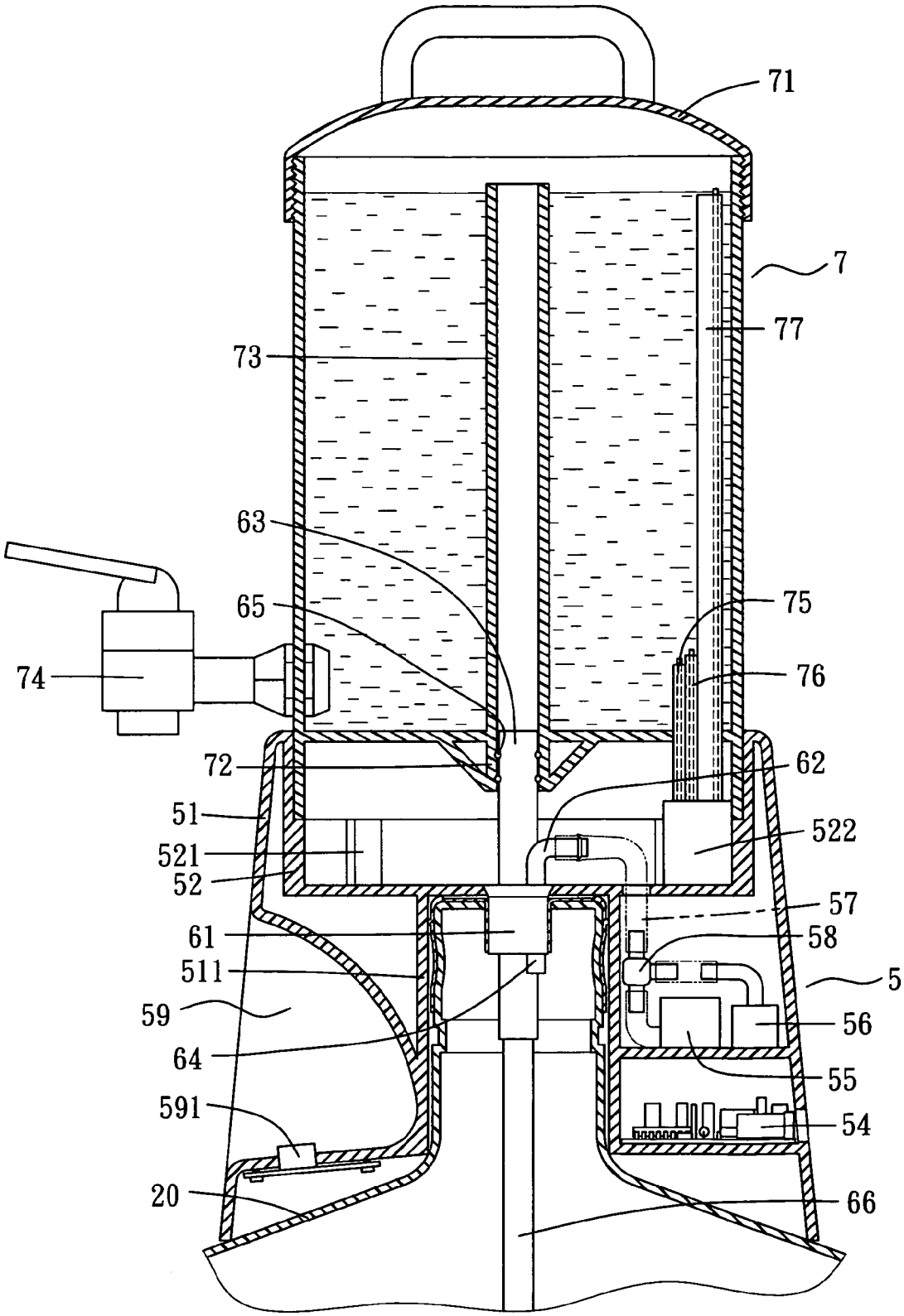
FIG. 18 is a side cross-sectional view of the second embodiment of a tank-type drinking water dispenser in the present invention, showing it in a high water level.

Next, in using the second embodiment, referring to FIGS. 13 to 19, firstly, the tank 20 full of drinking water is placed on the bottom base 8, with the securing walls 81 elastically constricting the tank 20 as shown in FIG. 13 for the bottom base 8 able to be moved around freely by the casters 82. Then the shell 51 is fitted tightly around the upper end of the tank 20, with the control device 5 with the water container 7 together is positioned on the tank 20. After that, the water connector 6 is inserted in the mouth of the tank 20, letting the outlet tube 66 extending down to the bottom of the tank 20. Then the power switch 541 is pressed to light up the power indicting lamp 542, and the air pump 55 and the electromagnetic valve 56 are started by handling the control circuit on the circuit board 54 in case of the empty condition of the water container 7, as shown in FIG. 14. Thus the air pump 55 begins to operate to pump air, and the electromagnetic valve is in the closed-up condition by being electrified, as shown in FIG. 15. Air pumped by the air pump 55 will flow along the air tube 57 in the shell 51, the T-shaped joint 58, the air joint 62 of the water connector 6 and the inlet mouth 64 into the tank 20 to become highly compressed air until it reaches a certain pressure value. Then the drinking water in the tank 20 is to be forced by the compressed air to flow through the water outlet tube 66, the water joint 63, the water tube 73 in the water container 7, finally into the interior of the water container 7, as shown in FIG. 16. When the dr inking water gradually fills the water container 7 and immerses the short and the medium sensing bar 75 and 76, the indicating lamp 592 for the lower water level is to be lit up, signaling that the drinking water in the water container 7 has already risen up to the level possible to be dispensed out for use. Meanwhile the air pump 55 continues to pump air as shown in FIG. 17, with the drinking water in the container 7 reaching the highest level of immersing totally the long sensing bar 77. At this time, the air pump 55 and the electromagnetic valve 56 are to be cut off power, with the valve of the electromagnetic valve 56 being opened as shown in FIG. 19, and with the compressed air in the tank 20 flowing through the inlet mouth 64, the air joint 62, the air tube 57 and into the electromagnetic valve 56 to be exhausted out lest the remaining air in the tank 20 pushes the drinking water to keep on pouring in the water container 7, which may then be overfilled.

When the drinking water is gradually used, letting the water level fall down to the lower level shown in FIG. 16, a user switches the control circuit to turn on power for starting the air pump 55 and the electromagnetic valve 56, with the indicating lamp for the low level lit up, pumping air to let the drinking water in the tank 20 flow in the water container 7 once again.

As can be understood from the aforesaid description, the pressured drinking water dispenser has an improved function to get rid of the disadvantage of the conventional drinking water dispenser, with the tank 20 not needed to be lifted up and then reversed to be placed on the dispenser body, and then the drinking water automatically flowing from the tank 20 placed on the ground into the water container positioned on the dispenser body.

Figure 20:
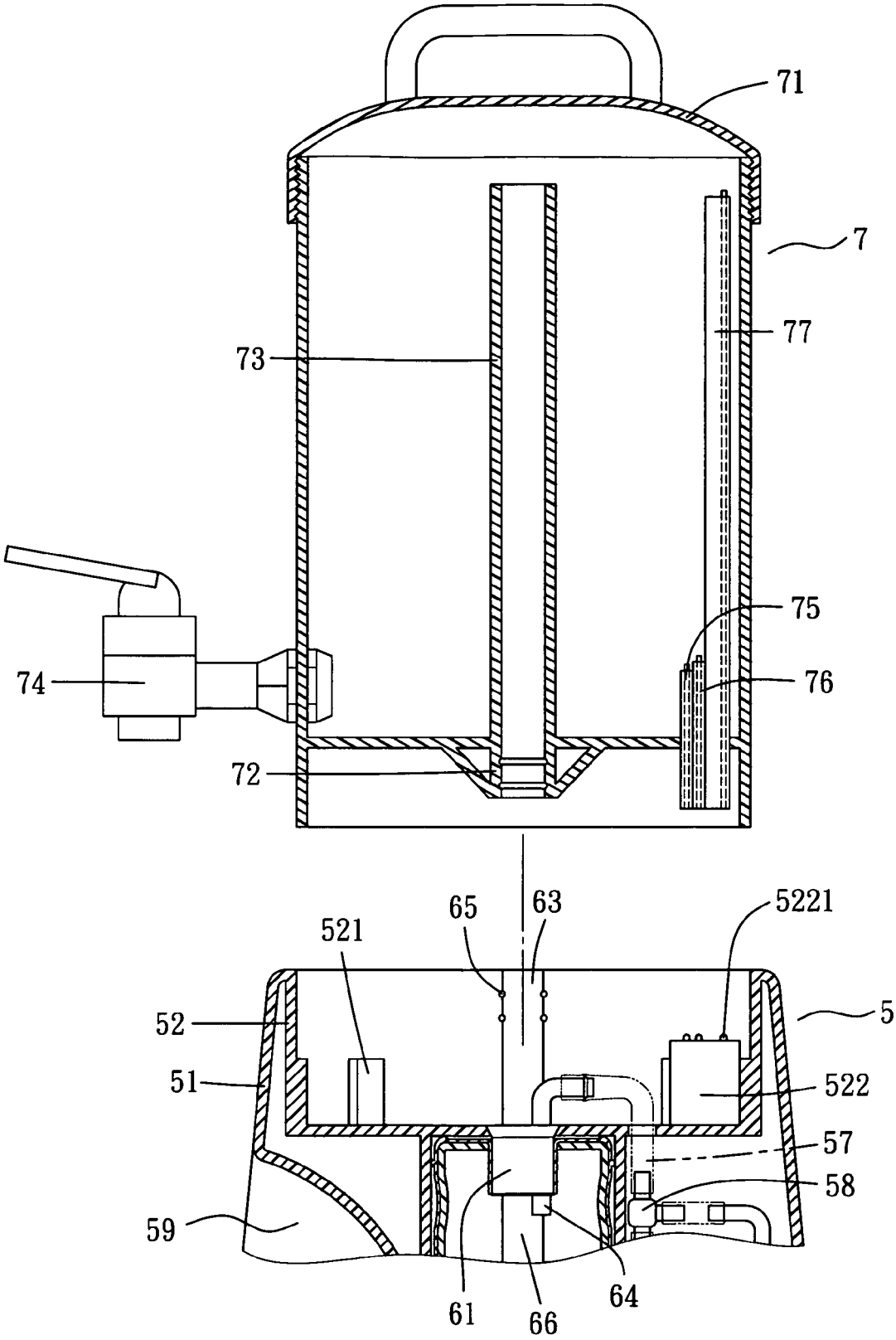

When the drinking water in the tank 20 is used up, a user only needs to take off the water connector 2 or 6 together with the control device 5 and the container 7 and then replaces the empty tank 20 with a new full tank 20. Then the water connector 2 or 6 is once again put back, and the drinking water may be pumped into the water container to be dispensed out for use again. Moreover, as the bottom base 8 for supporting the tank 20 is movable with the casters 82, so the second embodiment can be moved around anywhere, with the tank 20, the control device 5 and the water container moved at the same time, having a sharp mobility and a convenience. In addition, the water container 7 is placed in the recess 52 of the shell 51, quite easy to take off the shell 51 of the control device 5, as shown in FIG. 20. Thus the second embodiment has a special feature of separable design very beneficial for washing or carrying out.

While the preferred embodiments of the invention have been described above, it will be recognized and understood that various modifications may be made therein and the appended claims are intended to cover all such modifications that may fall within the spirit and scope of the invention.

What is claimed is:

1. A pressured drinking water dispenser comprising:

a dispenser body;

a control device having a circuit board, an air pump and an electromagnetic valve, said air pump and said electromagnetic valve mutually connected with an air tube via a control device air joint;

an air and water connector inserted in a tank cap of a tank, said connector provided with a connector air joint and a connector water joint extending up and respectively connected with said air tube and a water tube, said air tube connecting said control device and said air and water connector and said water tube connecting said dispenser body and said air and water connector, said connector air joint communicating with said tank for air to flow into said tank, and said connector water joint connected with a water outlet tube extending down to a bottom of said tank;

wherein air compressed by said air pump flows through said control device air joint, said air tube and said connector air joint when said air pump is electrified to operate, wherein air pumped by said air pump flows through said air tube into said tank when said electromagnetic valve is electrified to close, and wherein the air flowed into said tank becomes gradually highly compressed air in said tank and forces drinking water stored in said tank to flow out through said connector water joint and said water tube and automatically flowing finally into a water container in said dispenser body.

2. The pressured drinking water dispenser as claimed in claim 1, wherein when said electromagnetic valve is electrified, said electromagnetic valve is closed and does not let air flow through thereby letting the compressed air pumped by said air pump flow into said tank; and wherein when power to said electromagnetic valve is cut off, said electromagnetic valve is open and lets air flow through so that the compressed air in said tank may flow through said air tube and then out of said electromagnetic valve into outer air.

3. The pressured drinking water dispenser as claimed in claim 1, wherein said control device further has a cap, a separating plate and a funnel-shaped base; said separating plate is fixed between said cap and said funnel-shaped base, and said circuit board, said air pump and said electromagnetic valve are fixed on an upper surface of said separating plate; said funnel-shaped base is directly inserted into a receptive base of said dispenser body, said receptive base having a hollow interior for drinking water in said water tube to flow through and a water inlet formed in its lower end and communicating with the interior of said dispenser body, with said hollow interior forming said water container.

4. The pressured drinking water dispenser as claimed in claim 3, wherein said circuit board fixed on said separating plate is connected with three vertical sensing bars extending down into the interior of said funnel-shaped base, said three sensing bars consisting of a short bar, a medium bar and a long bar with different lengths and extending into the hollow interior of said receptive base, said air pump is under electrified condition and continues to pump air when the water level in said dispenser body contacts said medium and said long sensing bar, and said air pump is cut off from power to stop pumping operation when the water level contacts said short sensing bar.

5. The pressured drinking water dispenser as claimed in claim 1, wherein said tank cap has a water hole formed therein and said air and water connector has an upper end of its body shaped tapered down so as to fit tightly with said water hole of said tank cap.

6. The pressured drinking water dispenser as claimed in claim 1, wherein said control device further has a shell of a tapered cylindrical shape with an interior hollow, a tubular member formed in said interior hollow and having a mouth facing down and fitting around an outer surface of a mouth of said tank, a recess formed in an upper portion of said shell, a plurality of ribs formed spaced apart radially and projecting on an annular surface defining said recess, a center hole bored in the center of the bottom of said recess and communicating with said recess and said tubular member, said air and water connector inserted in said center hole, said circuit board, said air pump and said electromagnetic valve fixed in said interior hollow of said shell; a further comprising a water container having its lower end fitted in said recess of said shell and supported on said ribs, an insert tube extending down from the bottom of said container for said connector water joint to insert in, a container water tube extending up in said water container and having an upper opening and connected with said insert tube as integral, a faucet provided at an outer surface of the bottom of said water container, and drinking water in said tank flows through said water outlet tube in said tank, said connector water joint, said insert tube and said container water tube into the interior of said water container functioning as the water container of said dispenser body.

7. The pressured drinking water dispenser as claimed in claim 6, wherein a set of micro switch is further provided in said control device, positioned on the bottom of said recess of said shell, having three micro points on the upper surface; three sensing bars are provided in said water container, consisting of a short, a medium and a long sensing bar in different lengths, said air pump is electrified and continues to pump air when the water level in said water container immerses said short and said medium sensing bar, power to said air pump is cut off to stop pumping when the water level in the interior of said dispenser body immerses said long sensing bar.

8. The pressured drinking water dispenser as claimed in claim 1, wherein a bottom base is further provided for said tank to rest thereon, and a plurality of elastic vertical walls are spaced apart around on the outer circumference of said bottom base for constricting said tank, and a plurality of casters are provided under said bottom base to enable said bottom base together with said tank resting thereon to move around on the ground.

* * * * *